US009291026B2

(12) United States Patent
Wetzel et al.

(10) Patent No.: US 9,291,026 B2
(45) **Date of Patent: *Mar. 22, 2016**

(54) SEAL AROUND BRAIDED CABLE

(75) Inventors: James Rudolph Wetzel, Houston, TX (US); Nicolas A. Garibay, Houston, TX (US); Neil Griffiths, Houston, TX (US)

(73) Assignee: ZEITECS B.V., Rijswijk (NL)

( * ) Notice: Subject to any disclaimer, the term of this patent is extended or adjusted under 35 U.S.C. 154(b) by 883 days.

This patent is subject to a terminal disclaimer.

(21) Appl. No.: 13/447,001

(22) Filed: Apr. 13, 2012

(65) Prior Publication Data

US 2012/0292051 A1 Nov. 22, 2012

Related U.S. Application Data

(60) Provisional application No. 61/487,945, filed on May 19, 2011.

(51) Int. Cl.
*E21B 33/072* (2006.01)
*E21B 43/12* (2006.01)

(52) U.S. Cl.
CPC ..... *E21B 33/072* (2013.01); *E21B 43/128* (2013.01)

(58) Field of Classification Search
CPC ..... E21B 43/128; E21B 33/072
USPC ..... 264/338; 425/543
See application file for complete search history.

(56) References Cited

U.S. PATENT DOCUMENTS 2,725,713 A 12/1955 Blanchard
4,951,745 A 8/1990 Gentry et al.
5,429,194 A * 7/1995 Nice ..... 166/383
6,672,631 B1 1/2004 Weinhold
7,611,120 B2 * 11/2009 Wood ..... 251/1.3
2009/0145610 A1 6/2009 Varkey et al.
2010/0288493 A1 11/2010 Fielder et al.
2014/0102721 A1 * 4/2014 Bespalov et al. ..... 166/385

FOREIGN PATENT DOCUMENTS

EP 1847679 A1 10/2007
EP 1865145 A1 12/2007

OTHER PUBLICATIONS

PCT International Search Report and Written Opinion dated Apr. 17, 2013, International Application No. PCT/US2012/038657.
Premold Corp.—Process—Reaction Injection Molding Overview, Webpage http://www.premoldcorp.com/process.php, 2011.
Schey, John A.—Introduction to Manufacturing Processes, Second Edition, copyright 1987, 1977, McGraw-Hill, Inc., pp. 414-418.
Canadian Office Action dated Nov. 19, 2014, Canadian Patent Application No. 2,835,638.
Australian Examination Report dated Nov. 21, 2014, Australian Patent Application No. 2012255044.
(Continued)

*Primary Examiner* — David Andrews
(74) *Attorney, Agent, or Firm* — Michael Stonebrook

(57) ABSTRACT

A method of deploying a downhole tool into a wellbore includes: lowering a cable into the wellbore; after lowering the cable, engaging a mold with an outer surface of the cable; injecting sealant into the mold and into armor of the cable, thereby sealing a portion of the cable; lowering the downhole tool to a deployment depth using the cable; engaging a seal with the sealed portion of the cable; and operating the downhole tool using the cable.

12 Claims, 8 Drawing Sheets

(56) References Cited

OTHER PUBLICATIONS

GC Examination Report for Application No. GC 2012-2193 dated Dec. 2, 2014.

Canadian Office Action dated May 21, 2015, for Canadian Patent Application No. 2,835,638.

* cited by examiner

SEAL AROUND BRAIDED CABLE

CROSS-REFERENCE TO RELATED APPLICATIONS

This application claims benefit of U.S. provisional Pat. App. No. 61/487,945, filed May 19, 2011, which is herein incorporated by reference in its entirety.

BACKGROUND OF THE INVENTION

1. Field of the Invention

Embodiments of the present invention generally relate to a seal around a braided cable.

2. Description of the Related Art

In the oil and gas industry, the term wireline typically refers to a cable used by operators of oil and gas wells to lower downhole tools, such as logging sensors, into a wellbore for purposes of well intervention and reservoir evaluation. The wireline may be a braided line and may contain an inner core of insulated wires, which provide power to equipment located at the end of the wireline, and provides a pathway for electrical telemetry for communication between the surface and equipment at the end of the wireline. The wireline resides on the surface, wound around a large diameter (e.g., 3 to 10 feet diameter) spool of a winch. The winch may be portable (e.g., on the back of a truck) or a semi-permanent part of the drilling rig. The winch may include a motor and drive train operable to turn the spool, thereby raising and lowering the tools into and out of the well.

A pressure control head is also employed during wireline operations to contain pressure originating from the wellbore. However, braided cable presents problems as pressure is likely to communicate between and under the multiple strands of the braid. For this reason, the pressure control head includes a grease injector for injecting thick grease into and around the cable in conjunction with a stuffing box for sealing against an outer surface of the cable while allowing the wireline to slide through. However, if a more semi-permanent stationary seal is required around the braided cable (for example, in the deployment of a power cable suspended electric submersible pump (ESP) system) continuous grease injection may not be convenient.

SUMMARY OF THE INVENTION

Embodiments of the present invention generally relate to a seal around a braided cable. In one embodiment, a method of deploying a downhole tool into a wellbore includes: lowering a cable into the wellbore; after lowering the cable, engaging a mold with an outer surface of the cable; injecting sealant into the mold and into armor of the cable, thereby sealing a portion of the cable; lowering the downhole tool to a deployment depth using the cable; engaging a seal with the sealed portion of the cable; and operating the downhole tool using the cable.

In another embodiment, a cable for deploying and operating a downhole tool includes: one or more electrical conductors extending a length of the cable; a jacket disposed around each conductor and extending the cable length; one or more layers of armor disposed around the jackets; sealant impregnated in the armor and extending only a portion of the cable length. The cable length is greater than or equal to five hundred feet. A length of the sealed portion is less than or equal to one-tenth of the cable length.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

FIG. 1A illustrates the ESP and a stuffing box being lowered toward a production tree. FIG. 1B illustrates installation of a mold around the cable. FIG. 1C illustrates the ESP deployed and operating.

FIG. 2A illustrates the cable. FIG. 2B illustrates the mold assembled around the cable. FIG. 2C illustrates injection of sealant into the mold. FIG. 2D illustrates a portion of the cable impregnated by the sealant.

FIG. 3A illustrates a mold connected to the blowout preventer (BOP). FIG. 3B illustrates the ESP and the stuffing box being lowered toward the tree. FIG. 3C illustrates the ESP deployed and operating.

FIG. 4A is an enlargement of a portion of FIG. 3A illustrating the cable extending through the mold. FIG. 4B illustrates seals of the mold engaged with the cable. FIG. 4C illustrates injection of sealant into the mold. FIG. 4D illustrates a portion of the cable impregnated by the sealant.

DETAILED DESCRIPTION

Figure 1A:
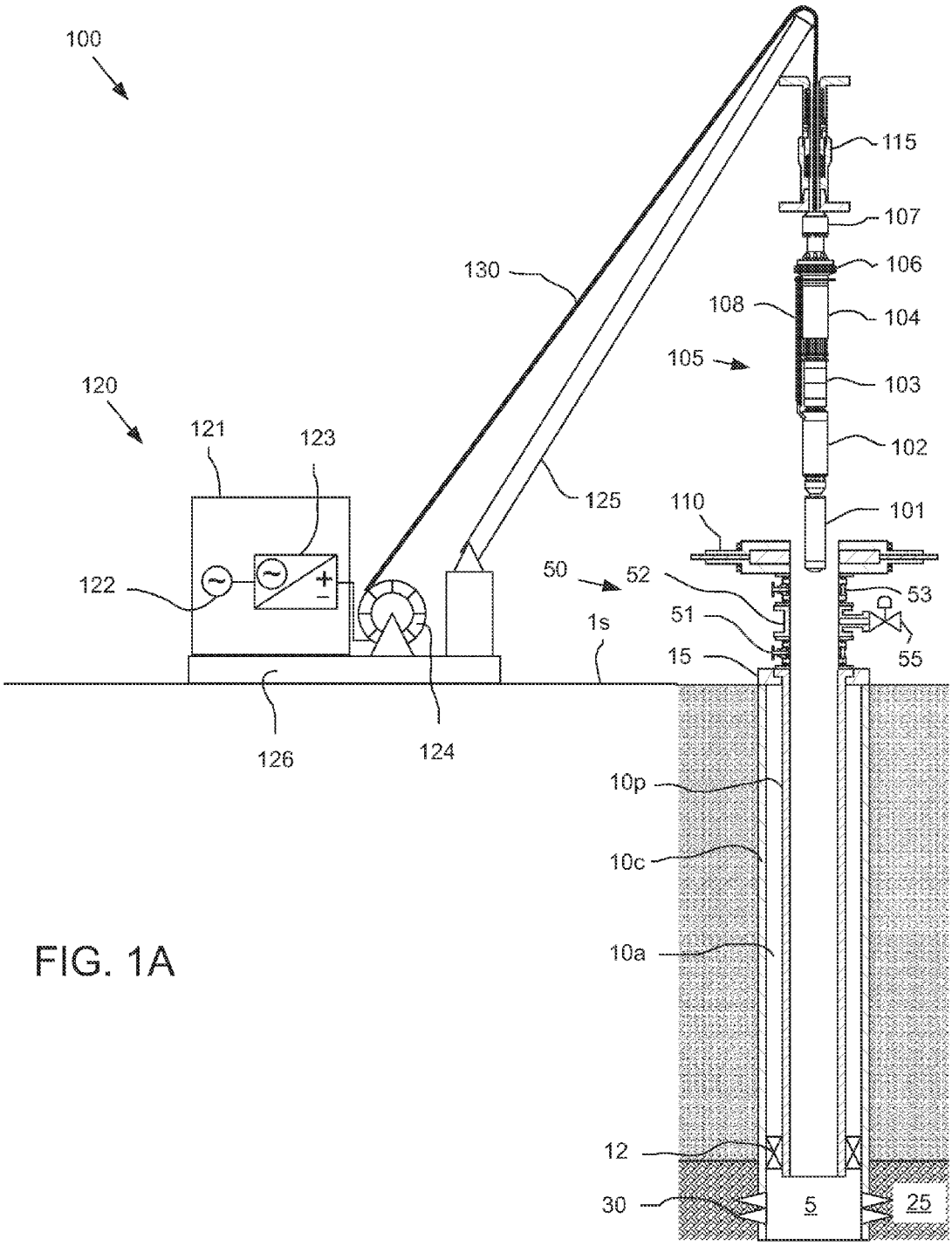
FIGS. 1A-1C illustrate deployment of an electric submersible pump (ESP) into a wellbore, according to one embodiment of the present invention.
Figure 1B:
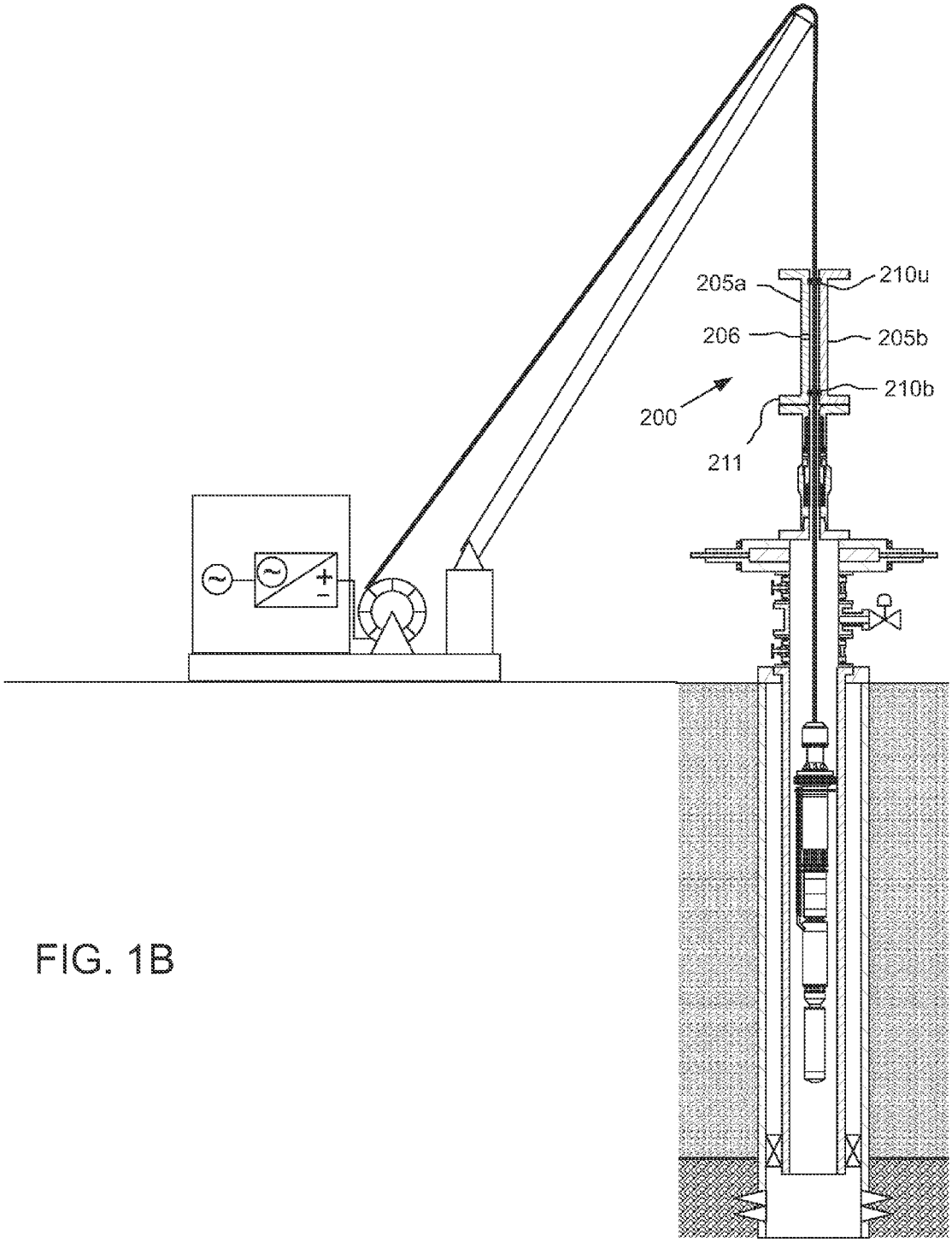
Figure 1C:
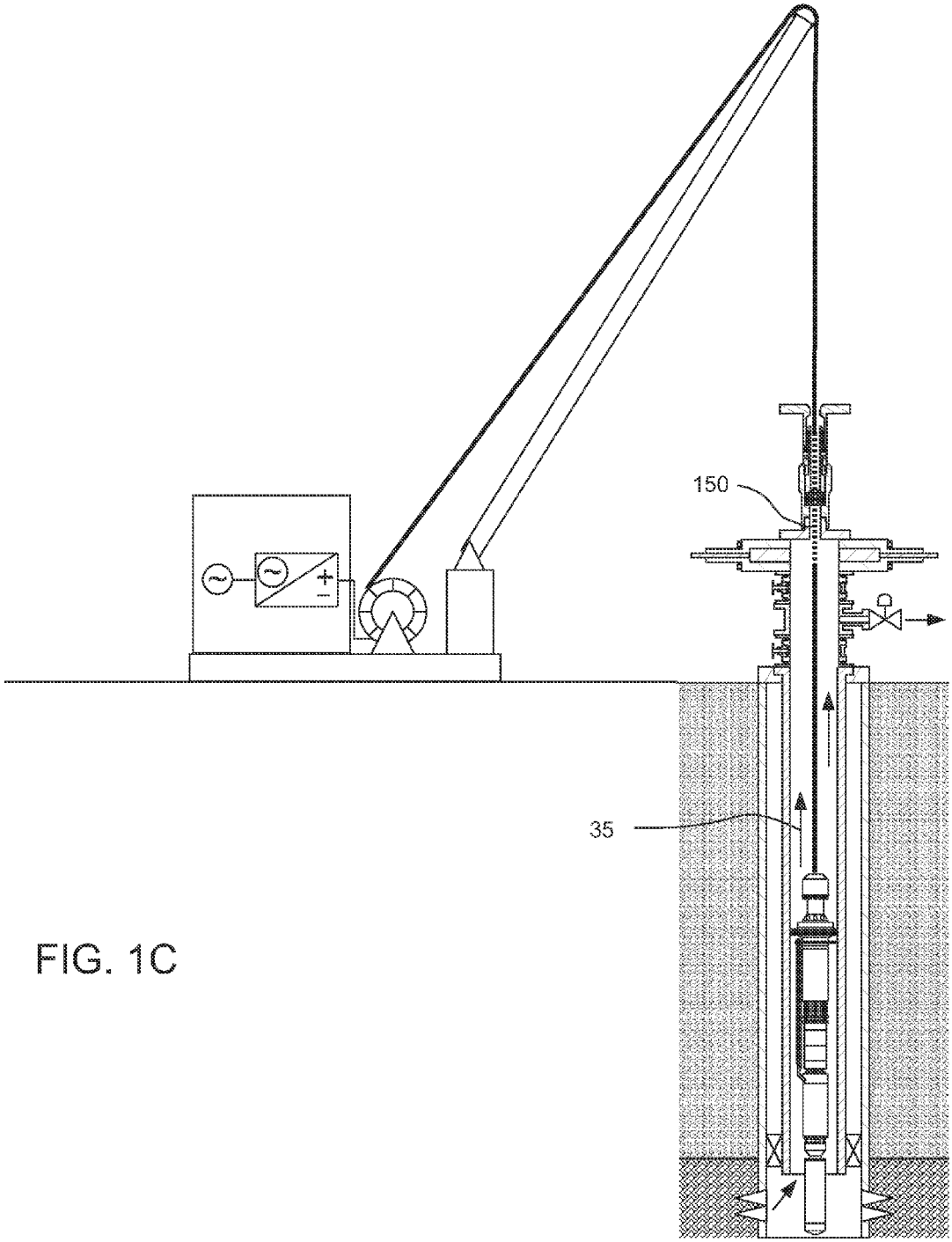

FIGS. 1A-1C illustrate deployment of an electric submersible pump (ESP) 105 into a wellbore 5, according to one embodiment of the present invention. FIG. 1A illustrates the ESP 105 and a stuffing box 115 being lowered toward a production tree 50. The ESP 105 may be part of an artificial lift system (ALS) 100. The ALS 100 may include the ESP 105, a blowout preventer (BOP) 110 or BOP stack (only one BOP shown), the stuffing box 115, and a launch and recovery system (LARS) 120.

The wellbore 5 has been drilled from a surface 1*s* of the earth into a hydrocarbon-bearing (i.e., crude oil and/or natural gas) reservoir 25. A string of casing 10*c* has been run into the wellbore 5, hung from a wellhead 15, and set therein with cement (not shown). The casing 10*c* has been perforated 30 to provide to provide fluid communication between the reservoir 25 and a bore of the casing 10*c*. A string of production tubing 10*p* extends from the wellhead 15 to the reservoir 25 to transport production fluid 35 (FIG. 1C) from the reservoir 25 to the surface 1*s*. A packer 12 has been set between the production tubing 10*p* and the casing 10*c* to isolate an annulus 10*a* formed between the production tubing and the casing from production fluid 35.

The production (aka Christmas) tree 50 may be installed on the wellhead 15. The production tree 50 may include a master valve 51, tee 52, a swab valve 53, a cap (not shown), and a production choke 55. Production fluid 35 from the reservoir 25 may enter a bore of the production tubing 10*p*, travel through the tubing bore to the surface 1*s*. The production fluid may continue through the master valve 51, the tee 52, and through the choke 55 to a flow line (not shown). The production fluid 35 may continue through the flowline to surface separation, treatment, and storage equipment (not shown). The reservoir 25 may be dead due to depletion or kill fluid or the reservoir may be live and isolated by a subsurface safety valve (not shown), thereby obviating the need for a lubricator (not shown). Alternatively, the wellbore 5 may be live and the lubricator may be employed to lower the ESP into the wellbore.

To prepare for insertion of the ESP 105 into the wellbore 5, one or more trucks (not shown) may deliver the ALS system 100 to the wellsite. The LARS 120 may include a control room 121, a winch 124 having cable 130 wrapped therearound, a boom 125, a generator 122, a controller 123, and a skid frame 126. The generator 122 may be diesel-powered and provide alternating current (AC) power. The LARS controller 123 may include a transformer (not shown) for stepping the voltage of the AC power signal from the generator 122 from a low voltage signal to a medium voltage signal. The low voltage signal may be less than or equal to one kilovolt (kV) and the medium voltage signal may be greater than one kV, such as three to ten kV. The LARS controller 123 may further include a rectifier for converting the medium voltage AC signal to a medium voltage direct current (DC) power signal for transmission downhole via the cable 130. The LARS controller 123 may be in electrical communication with the cable 130 via leads and an electrical coupling (not shown), such as brushes or slip rings, to allow power transmission through the cable while the winch 124 winds and unwinds the cable 130. The LARS controller 123 may further include a data modem (not shown) and a multiplexer (not shown) for modulating and multiplexing a data signal to/from the downhole controller with the DC power signal. The winch 124 may include an electric or hydraulic motor (not shown) and a drum rotatable by the motor for winding or unwinding of the cable 130.

The ESP 105 may include an electric motor 101, a power conversion module (PCM) 102, a seal section 103, a pump 104, an isolation device 106, a cablehead 107, and a flat cable 108. Housings of each of the ESP components may be longitudinally and rotationally connected, such as by flanged or threaded connections. The cablehead 107 may include a cable fastener (not shown), such as slips or a clamp for longitudinally connecting the ESP to the cable 130. Since the power signal may be DC, the cable 130 may only include two conductors arranged coaxially (discussed more below).

The cable 130 may be longitudinally coupled to the cablehead 107 by a shearable connection (not shown). The cable 130 may be sufficiently strong so that a margin exists between the deployment weight and the strength of the cable. For example, if the deployment weight is ten thousand pounds, the shearable connection may be set to fail at fifteen thousand pounds and the cable may be rated to twenty thousand pounds. The cablehead 107 may further include a fishneck so that if the ESP 105 become trapped in the wellbore 5, such as by jamming of the isolation device 106 or buildup of sand, the cable 130 may be freed from rest of the components by operating the shearable connection and a fishing tool (not shown), such as an overshot, may be deployed to retrieve the ESP 105.

The cablehead 107 may also include leads (not shown) extending therethrough and through the isolation device 106. The leads may provide electrical communication between the conductors of the cable 130 and conductors of the flat cable 108. The flat cable 108 may extend along the pump 104 and the seal section 102 to the PCM 102. The flat cable 108 may have a low profile to account for limited annular clearance between the components 103, 104 and the production tubing 10*p*. Since the flat cable 108 may conduct the DC signal, the flat cable may only require two conductors (not shown) and may only need to support its own weight. The flat cable 108 may be armored by a metal or alloy.

The motor 101 may be an induction motor, a switched reluctance motor (SRM) or a permanent magnet motor, such as a brushless DC motor (BLDC). The motor 101 may be filled with a dielectric, thermally conductive liquid lubricant, such as motor oil. The motor 101 may be cooled by thermal communication with the production fluid 35. The motor 101 may include a thrust bearing (not shown) for supporting a drive shaft (not shown). In operation, the motor 101 may rotate the drive shaft, thereby driving a pump shaft (not shown) of the pump 104. The drive shaft may be directly connected to the pump shaft (no gearbox).

The induction motor may be a two-pole, three-phase, squirrel-cage induction type and may run at a nominal speed of thirty-five hundred rpm at sixty Hz. The SRM motor may include a multi-lobed rotor made from a magnetic material and a multi-lobed stator. Each lobe of the stator may be wound and opposing lobes may be connected in series to define each phase. For example, the SRM motor may be three-phase (six stator lobes) and include a four-lobed rotor. The BLDC motor may be two pole and three phase. The BLDC motor may include the stator having the three phase winding, a permanent magnet rotor, and a rotor position sensor. The permanent magnet rotor may be made of one or more rare earth, ceramic, or cermet magnets. The rotor position sensor may be a Hall-effect sensor, a rotary encoder, or sensorless (i.e., measurement of back EMF in undriven coils by the motor controller).

The PCM 102 may include a power supply, a motor controller (not shown), a modem (not shown), and demultiplexer (not shown). The power supply may include one or more DC/DC converters, each converter including an inverter, a transformer, and a rectifier for converting the DC power signal into an AC power signal and reducing the voltage from medium to low. Each converter may be a single phase active bridge circuit as discussed and illustrated in PCT Publication WO 2008/148613, which is herein incorporated by reference in its entirety. The power supply may include multiple DC/DC converters in series to gradually reduce the DC voltage from medium to low. For the SRM and BLDC motors, the low voltage DC signal may then be supplied to the motor controller. For the induction motor, the power supply may further include a three-phase inverter for receiving the low voltage DC power signal from the DC/DC converters and outputting a three phase low voltage AC power signal to the motor controller.

For the induction motor, the motor controller may be a switchboard (i.e., logic circuit) for simple control of the motor at a nominal speed or a variable speed drive (VSD) for complex control of the motor. The VSD controller may include a microprocessor for varying the motor speed to achieve an optimum for the given conditions. The VSD may also gradually or soft start the motor, thereby reducing start-up strain on the shaft and the power supply and minimizing impact of adverse well conditions.

For the SRM or BLDC motors, the motor controller may receive the low voltage DC power signal from the power supply and sequentially switch phases of the motor, thereby supplying an output signal to drive the phases of the motor. The output signal may be stepped, trapezoidal, or sinusoidal. The BLDC motor controller may be in communication with the rotor position sensor and include a bank of transistors or thyristors and a chopper drive for complex control (i.e., variable speed drive and/or soft start capability). The SRM motor controller may include a logic circuit for simple control (i.e. predetermined speed) or a microprocessor for complex control (i.e., variable speed drive and/or soft start capability). The SRM motor controller may use one or two-phase excitation, be unipolar or bi-polar, and control the speed of the motor by controlling the switching frequency. The SRM motor controller may include an asymmetric bridge or half-bridge.

The modem and demultiplexer may demultiplex a data signal from the DC power signal, demodulate the signal, and transmit the data signal to the motor controller. The motor controller may be in data communication with one or more sensors (not shown) distributed throughout the ESP 105. A pressure and temperature (PT) sensor may be in fluid communication with the reservoir fluid 35 entering an inlet of the pump 104. A gas to oil ratio (GOR) sensor may also be in fluid communication with the reservoir fluid 35 entering the pump inlet. A second PT sensor may be in fluid communication with the reservoir fluid 35 discharged from an outlet of the pump 104. A temperature sensor (or PT sensor) may be in fluid communication with the lubricant to ensure that the motor 101 and PCM 102 are being sufficiently cooled. Multiple temperature sensors may also be included in the PCM 102 for monitoring and recording temperatures of the various electronic components. A voltage meter and current (VAMP) sensor may be in electrical communication with the cable 130 to monitor power loss from the cable. A second VAMP sensor may be in electrical communication with the power supply output to monitor performance of the power supply. Further, one or more vibration sensors may monitor operation of the motor 101, the pump 104, and/or the seal section 103. A flow meter may be in fluid communication with the pump outlet for monitoring a flow rate of the pump 104. Utilizing data from the sensors, the motor controller may monitor for adverse conditions, such as pump-off, gas lock, or abnormal power performance and take remedial action before damage to the pump 104 and/or motor 101 occurs.

The seal section 103 may isolate the reservoir fluid 35 being pumped through the pump 104 from the lubricant in the motor 101 by equalizing the lubricant pressure with the pressure of the reservoir fluid 35. The seal section 103 may rotationally connect the drive shaft to the pump shaft. The seal section 103 may house a thrust bearing capable of supporting thrust load from the pump 104. The seal section 103 may be positive type or labyrinth type. The positive type may include an elastic, fluid-barrier bag to allow for thermal expansion of the motor lubricant during operation. The labyrinth type may include tube paths extending between a lubricant chamber and a reservoir fluid chamber providing limited fluid communication between the chambers.

The pump inlet may be standard type, static gas separator type, or rotary gas separator type depending on the GOR of the production fluid 35. The standard type inlet may include a plurality of ports allowing reservoir fluid 35 to enter a lower or first stage of the pump 104. The standard inlet may include a screen to filter particulates from the reservoir fluid 35. The static gas separator type may include a reverse-flow path to separate a gas portion of the reservoir fluid 35 from a liquid portion of the reservoir fluid 35.

The isolation device 106 may include a packer, an anchor, and an actuator. The actuator may be operated mechanically by articulation of the cable 130, electrically by power from the cable, or hydraulically by discharge pressure from the pump 104. The packer may be made from a polymer, such as a thermoplastic, elastomer, or copolymer, such as rubber, polyurethane, or PTFE. The isolation device 106 may have a bore formed therethrough in fluid communication with the pump outlet and have one or more discharge ports formed above the packer for discharging the pressurized reservoir fluid into the production tubing 10*p*. Once the ESP 105 has reached deployment depth, the isolation device actuator may be operated, thereby setting the anchor and expanding the packer against the production tubing 10*p*, isolating the pump inlet from the pump outlet, and rotationally connecting the ESP 105 to the production tubing. The anchor may also longitudinally support the ESP 105.

Additionally, the isolation device 106 may include a bypass vent (not shown) for releasing gas separated by the pump inlet that may collect below the isolation device and preventing gas lock of the pump 104. A pressure relief valve (not shown) may be disposed in the bypass vent. Additionally, a downhole tractor (not shown) may be integrated into the cable 130 to facilitate the delivery of the ESP 105, especially for highly deviated wells, such as those having an inclination of more than forty-five degrees or dogleg severity in excess of five degrees per one hundred feet. The drive and wheels of the tractor may be collapsed against the cable and deployed when required by a signal from the surface.

The pump 104 may be centrifugal or positive displacement. The centrifugal pump may be a radial flow or mixed axial/radial flow. The positive displacement pump may be progressive cavity. The pump 104 may include one or more stages (not shown). Each stage of the centrifugal pump may include an impeller and a diffuser. The impeller may be rotationally and longitudinally connected to the pump shaft, such as by a key. The diffuser may be longitudinally and rotationally coupled to a housing of the pump, such as by compression between a head and base screwed into the housing. Rotation of the impeller may impart velocity to the reservoir fluid 35 and flow through the stationary diffuser may convert a portion of the velocity into pressure. The pump 104 may deliver the pressurized reservoir fluid 35 to the isolation device bore.

Alternatively, the pump 104 may be a high speed compact pump discussed and illustrated at FIGS. 1C and 1D of U.S. patent application Ser. No. 12/794,547, filed Jun. 4, 2010, which is herein incorporated by reference in its entirety. High speed may be greater than or equal to ten thousand, fifteen thousand, or twenty thousand revolutions per minute (RPM). The compact pump may include one or more stages, such as three. Each stage may include a housing, a mandrel, and an annular passage formed between the housing and the mandrel. The mandrel may be disposed in the housing. The mandrel may include a rotor, one or more helicoidal rotor vanes, a diffuser, and one or more diffuser vanes. The rotor may include a shaft portion and an impeller portion. The rotor may be supported from the diffuser for rotation relative to the diffuser and the housing by a hydrodynamic radial bearing formed between an inner surface of the diffuser and an outer surface of the shaft portion. The rotor vanes may interweave to form a pumping cavity therebetween. A pitch of the pumping cavity may increase from an inlet of the stage to an outlet of the stage. The rotor may be longitudinally and rotationally connected to the motor drive shaft and be rotated by operation of the motor. As the rotor is rotated, the production fluid 35 may be pumped along the cavity from the inlet toward the outlet. The annular passage may have a nozzle portion, a throat portion, and a diffuser portion from the inlet to the outlet of each stage, thereby forming a Venturi.

The tree cap may be removed from the tree 50. The BOP 110 may be connected to the swab valve 53, such as by fastening. The BOP 110 may include one or more ram BOPS, such as two. The first ram BOP may include a pair of blind-shear rams (or separate blind rams and shear rams) capable of cutting the cable 130 when actuated and sealing the bore, and a second ram BOP may include a pair of cable rams for sealing against an outer surface of the cable 130 when actuated. The LARS 120 may further include a hydraulic power unit (HPU, not shown) for operating the BOP stack 110. Once the BOP 110 has been installed, the cable 130 may then be inserted through the stuffing box 115 and fastened to the cablehead 105. The boom 125 may be used to hoist the ESP and stuffing box over the BOP 110. The swab valve 53 and master valve 51 may then be opened. The ESP 105 may be lowered through the tree 50 and into the wellbore until the stuffing box 115 engages the BOP 110. Lowering may be halted and the stuffing box 115 may be fastened to the BOP 110, such as by a flanged connection. Lowering of the ESP 105 into the wellbore 5 may resume until the ESP is proximately above deployment depth.

FIG. 1B illustrates installation of a mold 200 around the cable 130. The winch 124 may be locked with the ESP 105 in the wellbore 5 proximately above deployment depth. Alternatively, the isolation device 106 may be set to support the ESP 105. The mold 200 may be assembled around the cable 130 above the stuffing box 115.

Figure 2A:
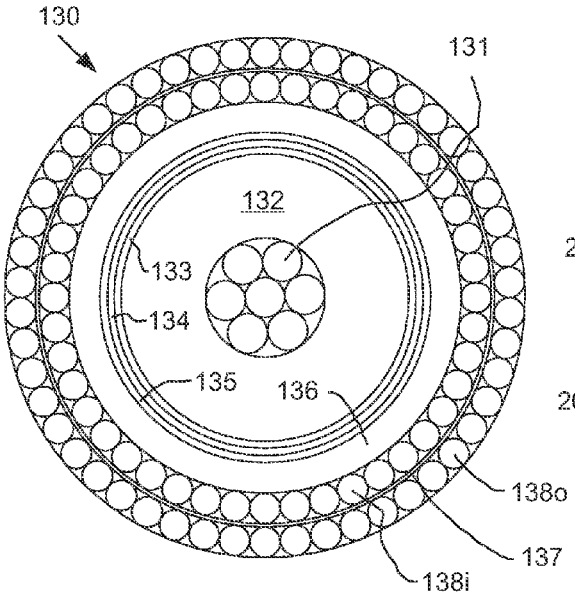
FIGS. 2A-2D illustrate molding a portion of a cable with sealant.

FIGS. 2A-2D illustrate molding a portion 150 of the cable 130 with sealant 250. FIG. 2A illustrates the cable 130. The cable 130 may include an inner core 131, an inner jacket 132, a shield 133, an outer jacket 136, and one or more layers 138*i,o* of armor.

The inner core 131 may be the first conductor and made from an electrically conductive material, such as aluminum, copper, or alloys thereof. The inner core 131 may be solid or stranded (shown). The inner jacket 132 may electrically isolate the core 131 from the shield 133 and be made from a dielectric material, such as a polymer. The shield 133 may serve as the second conductor and be made from the electrically conductive material. The shield 133 may be tubular (shown), braided, or a foil covered by a braid. The outer jacket 136 may electrically isolate the shield 133 from the armor 138*i,o* and be made from an oil-resistant dielectric material. The armor may be made from one or more layers 138*i,o* of high strength material (i.e., tensile strength greater than or equal to one hundred, one fifty, or two hundred kpsi) to support the deployment weight (weight of the cable 130 and the weight of the ESP 105)) so that the cable 130 may be used to deploy and remove the ESP 105 into/from the wellbore 5. The high strength material may be a metal or alloy and corrosion resistant, such as galvanized steel or a nickel alloy depending on the corrosiveness of the reservoir fluid 35. The armor may include two contra-helically wound layers 138*i,o* of wire or strip.

Additionally, the cable 130 may include a sheath 135 disposed between the shield 133 and the outer jacket 136. The sheath 135 may be made from lubricative material, such as polytetrafluoroethylene (PTFE) or lead, and may be tape helically wound around the shield 133. If lead is used for the sheath 135, a layer of bedding 134 may insulate the shield 133 from the sheath and be made from the dielectric material. Additionally, a buffer 137 may be disposed between the armor layers 138*i,o*. The buffer 137 may be tape and may be made from the lubricative material. The buffer 137 may be perforated to allow sealant flow to the inner armor layer 138*i*

Due to the coaxial arrangement, the cable 130 may have an outer diameter less than or equal to one and one-quarter inches, one inch, or three-quarters of an inch. Alternatively, the conductors 131, 133 may be eccentrically arranged and/or the cable 130 may include three or more conductors, such as three, and conduct three-phase AC power to the motor 101 (obviating the PCM 102). Alternatively, the cable 130 may include only one conductor and the production tubing 10*p* may be used for the other conductor.

Figure 2B:
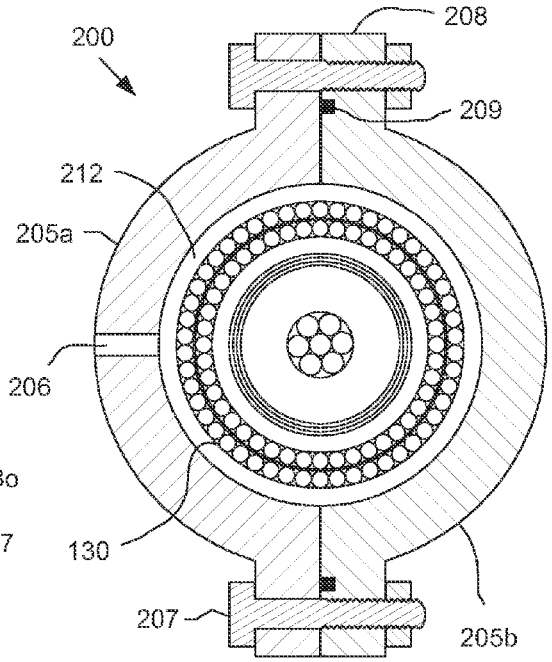

FIG. 2B illustrates the mold 200 assembled around the cable 130. The mold 200 may be delivered to the wellsite by a service truck (not shown). The service truck may include a reaction injector and a crane or platform to lift the mold to a top of the stuffing box. The reaction injector may include a pair of supply tanks each having a liquid reactive component (aka resin and hardener) stored therein. The supply tanks or the components may or may not be heated. The service truck may further include a pair of feed pumps, each having an inlet connected to a respective supply tank. An outlet of each supply pump may be connected to a mix head and an outlet of the mix head may connect to the mold 200. The service truck may further include an HPU for powering the supply pumps. The service truck may further include a controller for proportioning the feed pumps. The feed pumps may be operated to simultaneously supply the liquid reactive components to the mix head. The mix head may impinge the liquid components to begin polymerization of the sealant mixture 250. The sealant mixture 250 may continue from the mix head into the mold 200.

Alternatively, the service truck may include an injector, a crane or platform to lift the injector and the mold to a top of the stuffing box, and an HPU to power the injector. The injector may include a hopper, a barrel, a driver, and a heater. The heater may surround the mold side of the barrel. The driver may be a rotating screw disposed in the barrel. The screw may have a feed section, transition section, and a metering section. The feed section may receive sealant pellets from the hopper and convey them to the transition section. The transition section may compress the pellets into a molten sealant and pump the molten sealant to the metering section. The screw may be supported by a hydraulic ram that is displaced away from the mold by the sealant feed through the screw. The hydraulic ram may then reverse to inject the molten sealant into the mold. Alternatively, the driver may be a hydraulic plunger and a torpedo spreader.

The mold 200 may include a split housing 205 and upper 210*u* and lower 210*b* seals (FIG. 1B). The housing 205 may include a pair of mating semi-tubular segments 205*a,b*. Each housing segment 205*a,b* may have radial couplings, such as flanges 208, formed therealong and half of a longitudinal coupling 211 formed at one or both longitudinal ends thereof. The radial flanges 208 of each housing segment 205*a,b* may be connected to the mating radial flanges by fasteners 207, such as bolts and nuts. A gasket 209 may be disposed in a groove formed in one of the housing segments for sealing the radial connection. Alternatively, the radial couplings may instead be a hinge and latch. Each seal 210*u,b* may include a pair of mating semi-annular segments. One segment of each seal 210*u,b* may include a coupling (not shown) formed at ends thereof, such as a ball and the other segment may include a mating coupling, such as a socket, so that the couplings mate when the housing 205 is assembled.

An inner diameter of the mold housing 205 may be slightly greater than an outer diameter of the cable 130, thereby forming an annulus 212 between the mold housing and the cable. The housing 205 may have a sprue 206 formed through a wall of one of the segments 205*a,b* and in fluid communication with the annulus 212. An inner diameter of the mold seals 210*u,b* may be slightly less than an outer diameter of the cable 130 so that the mold seals engage an outer surface of the cable when the mold 200 is assembled.

The service truck crane/platform may lift each of the housing segments 205*a,b* on to the stuffing box 115. The housing segments 205*a,b* may be radially assembled around the cable 130 using the fasteners 207. The assembled housing 205 may then be connected to the stuffing box 115 via the flange 211. Alternatively, the housing 205 may just rest on the stuffing box 115.

Figure 2C:
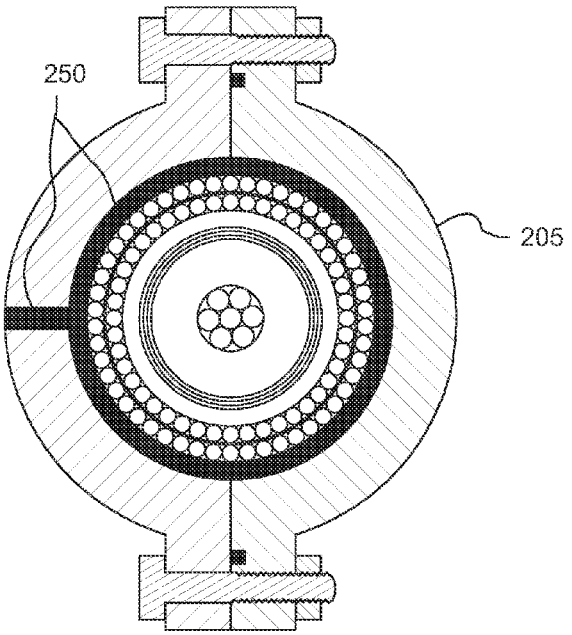

FIG. 2C illustrates injection of sealant 250 into the mold 200. The sealant 250 may be a polymer, such as a thermoplastic, elastomer, copolymer, or thermoset, such as polyisoprene, polybutadiene, polyisobutylene, polychloroprene, butadiene-styrene rubber, styrene-butadiene copolymer (thermoplastic elastomer), butadiene-acrylonitrile, acrylonitrile butadiene styrene (ABS), silicone, ethylene propylene diene monomer (EPDM) rubber, or polyurethane.

Once the mold 200 has been assembled around the cable 130, the mix head may be lifted to the mold 200 by the service truck crane or the service truck platform may lift the reaction injector to the mold 200. The mix head may be connected to the sprue 206. The supply pumps may then be operated to pump the liquid reactants to the mix head. The sealant mixture 250 may continue from the mix head into the mold 200. Air displaced by the sealant mixture 250 may vent from the mold via leakage through and along the armor 138*i,o*. The sealant mixture 250 may flow around and along the annulus 212 until the sealant mixture 250 encounters the seals 210*u,b*. Pressure in the mold 200 may increase and the sealant mixture 250 may be forced into the armor 138*i,o*. Sealant penetration into the cable 130 may be stopped by the outer jacket 136. Pumping of the sealant mixture 250 may continue until the mold 200 is filled. The mold 200 may be heated by exothermic polymerization of the mixture 250. A melting temperature of the mold seals 210*u,b*, gasket 209, and outer jacket 136 may be suitable to withstand the exothermic reaction.

Figure 2D:
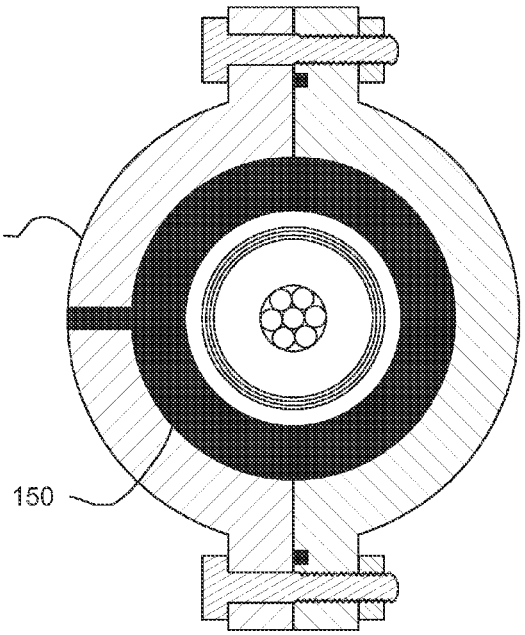

FIG. 2D illustrates a portion 150 of the cable 130 impregnated by the sealant 250. Once the sealant 250 has cured and cooled to at least a point sufficient to maintain structural integrity, the mix head may be disconnected from the mold 200 and the mold 200 may be disconnected from the stuffing box 115. The fasteners 207 may then be removed. The service truck may further include a hydraulic spreader. The spreader may be connected to the mold 200 and operated to separate the mold. The service truck may stow the mold 200 and mix head and leave the wellsite.

A length of the sealed portion 150 may be greater than or equal to a length of a seal of the stuffing box 115. For example, the sealed portion length may be greater than or equal to one foot, three feet, five feet, six feet, or ten feet. A length of the cable 130 may be greater than or equal to five hundred or one thousand feet. The sealed portion length may be substantially less than a length of the cable 130, such as less than or equal to one-tenth, one hundredth, or one thousandth the cable length. An outer diameter of the sealed portion 150 may be slightly greater than an outer diameter of the rest of the cable 130. Alternatively, the outer diameter of the sealed portion 150 may be equal to an outer diameter of the rest of the cable 130, such as by eliminating the annulus 212 or trimming the sealed portion.

FIG. 1C illustrates the ESP 105 deployed and operating. The winch 124 may then be unlocked and operated to lower the ESP 105 to deployment depth. As the ESP 105 is lowered, the sealed portion 150 may be lowered into alignment with the stuffing box seal. The isolation device 106 may then be set to engage the production tubing 10*p* and the stuffing box 115 may be operated to engaged the sealed portion 150. The ESP 105 may then be operated to pump production fluid 35 from the wellbore 5 to the tree 50 and through the tree to the surface separation, treatment, and storage equipment.

Figure 3A:
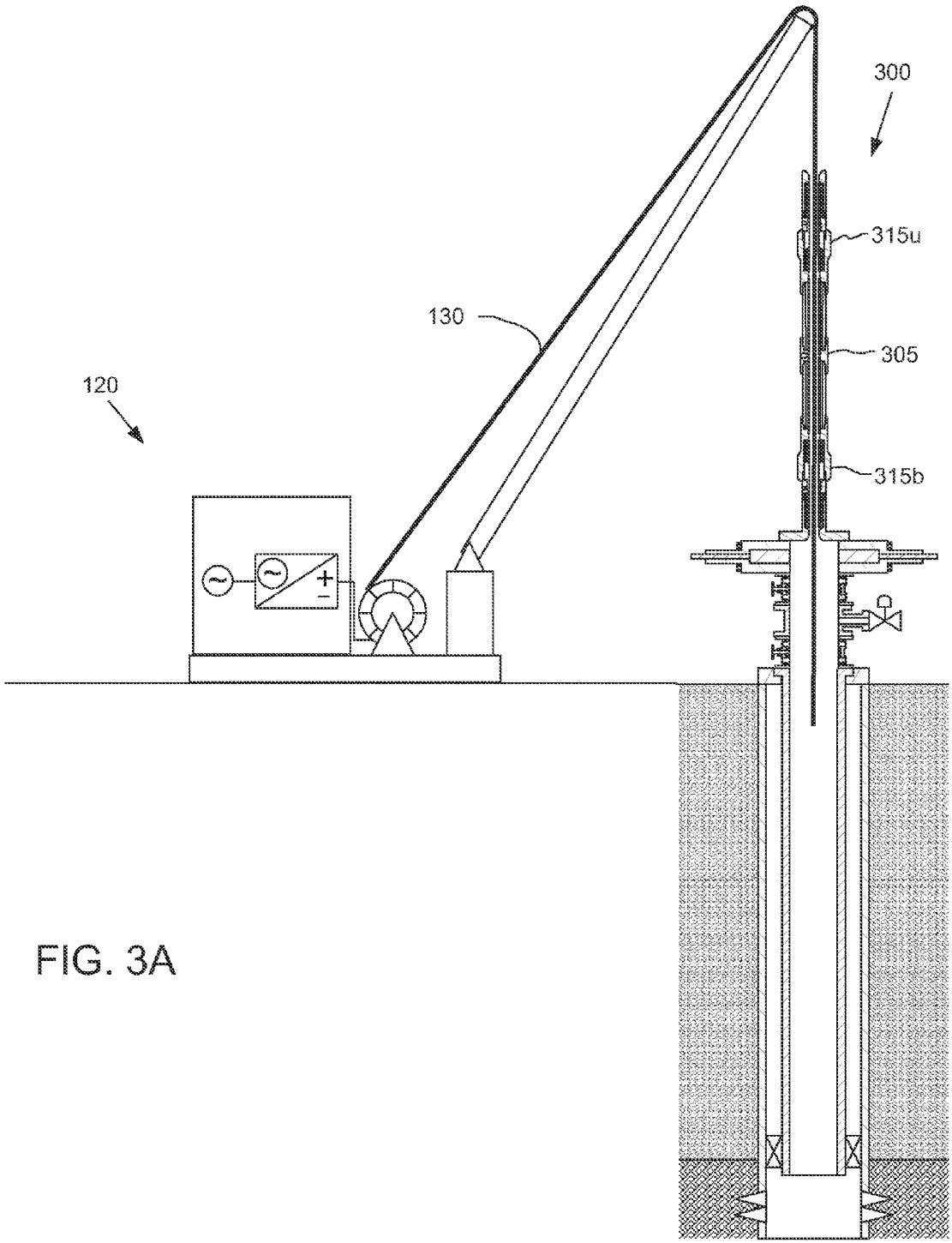
FIGS. 3A-3C illustrate deployment of the ESP into the wellbore, according to another embodiment of the present invention.
Figure 3B:
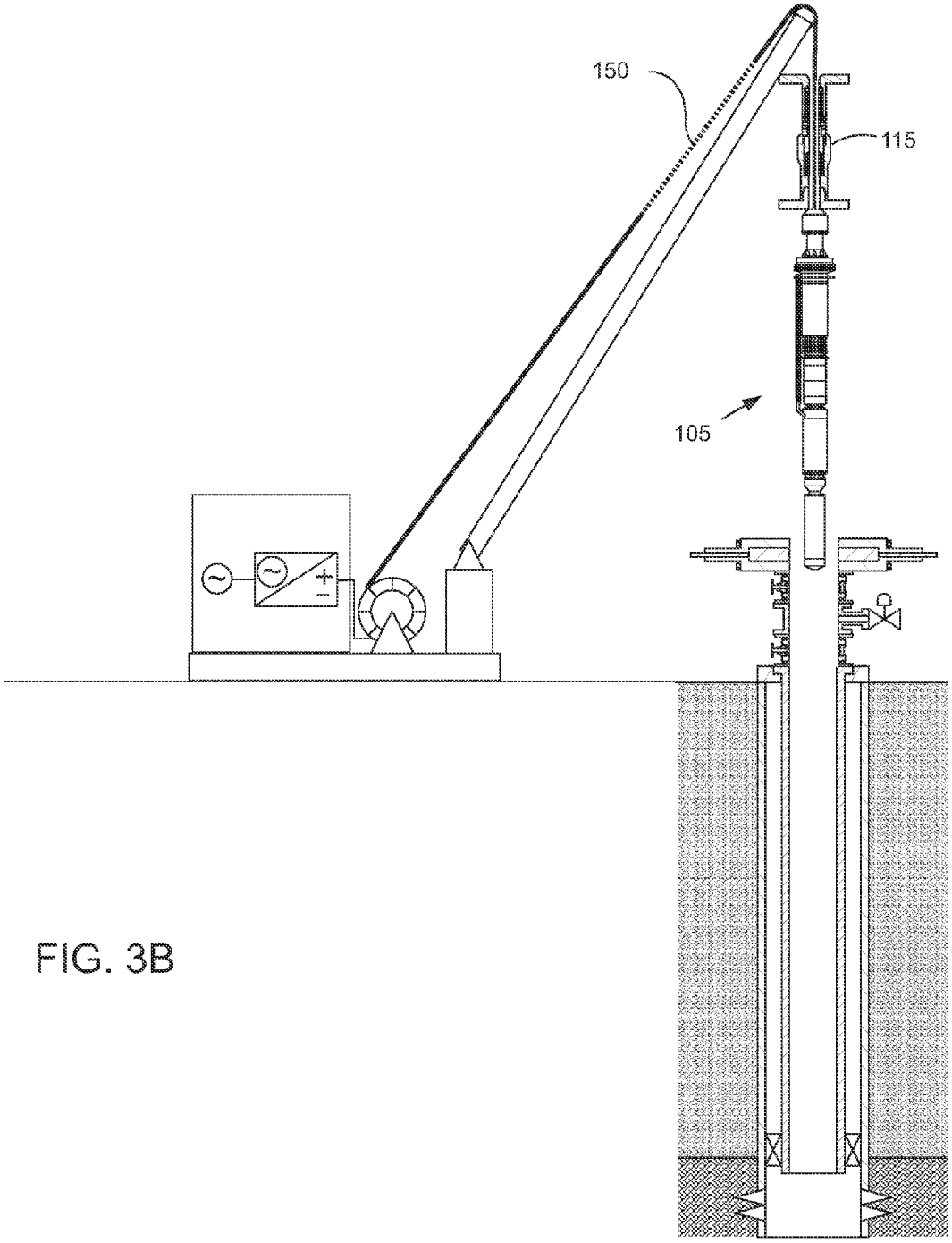
Figure 3C:
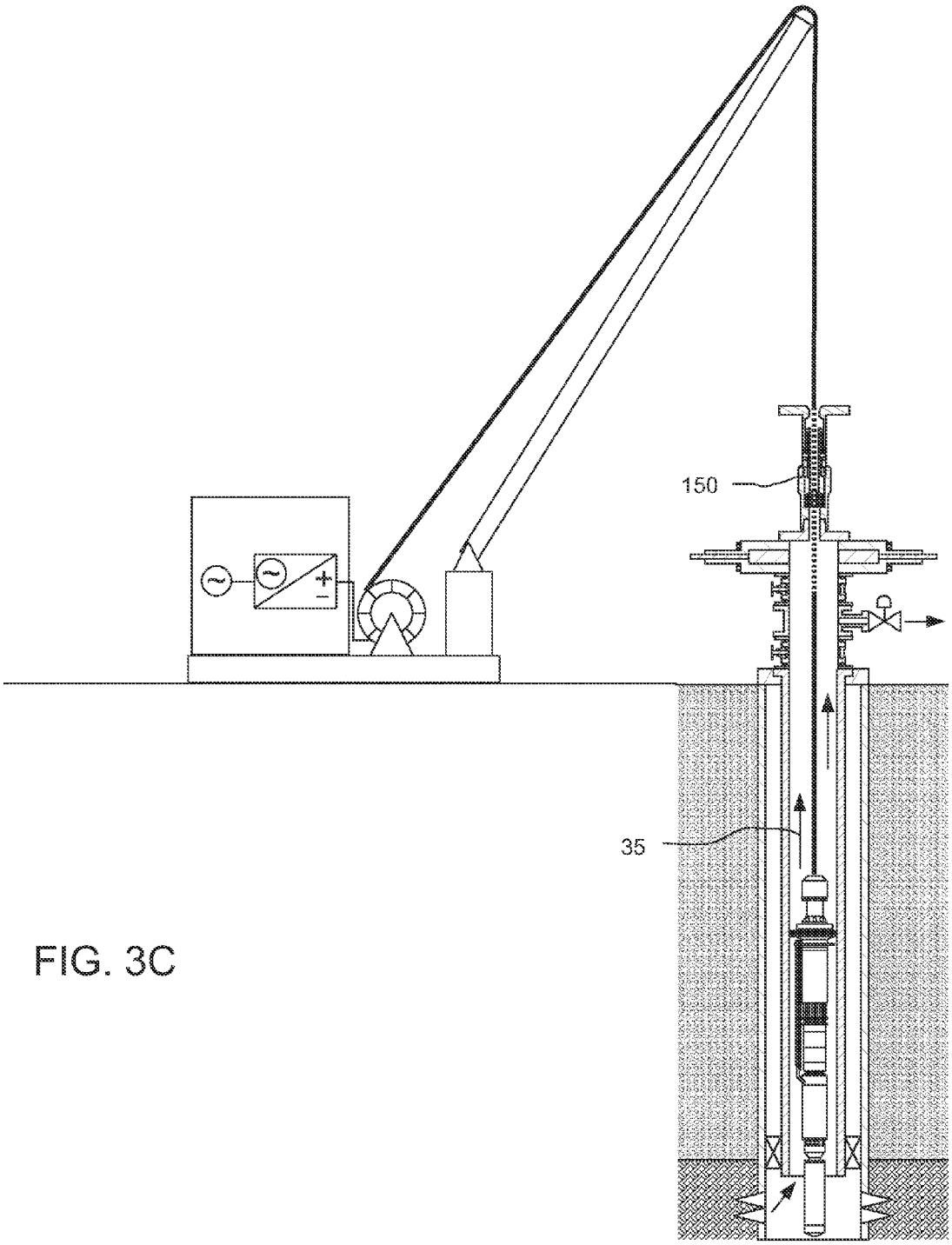

FIGS. 3A-3C illustrate deployment of the ESP 105 into the wellbore, 5 according to another embodiment of the present invention. FIG. 3A illustrates a mold 300 connected to the BOP 110. The service truck discussed above in conjunction with the mold 200 may deliver the mold 300 to the wellsite. The tree cap may be removed from the tree 50. The BOP 110 may be connected to the swab valve 53. The swab valve 53 and master valve 51 may then be opened. The cable 130 may then be inserted through the mold 300. A cablehead (not shown) may be fastened to the cable 130 and used to lift the mold 300 over the BOP 110 and lower the mold on to the BOP. The mold 300 may then be fastened to the BOP 110. Alternatively, the platform/crane of the service truck may be used to lift the mold 300 on to the BOP 110. The mold 300 may then be fastened to the BOP 110 and the cable 130 may be inserted through the mold and the tree 50 into the wellbore 5. The cable 130 may then be lowered into the wellbore 5 until proximately above the ESP deployment depth.

Figures 4A, 4B, 4C, 4D:
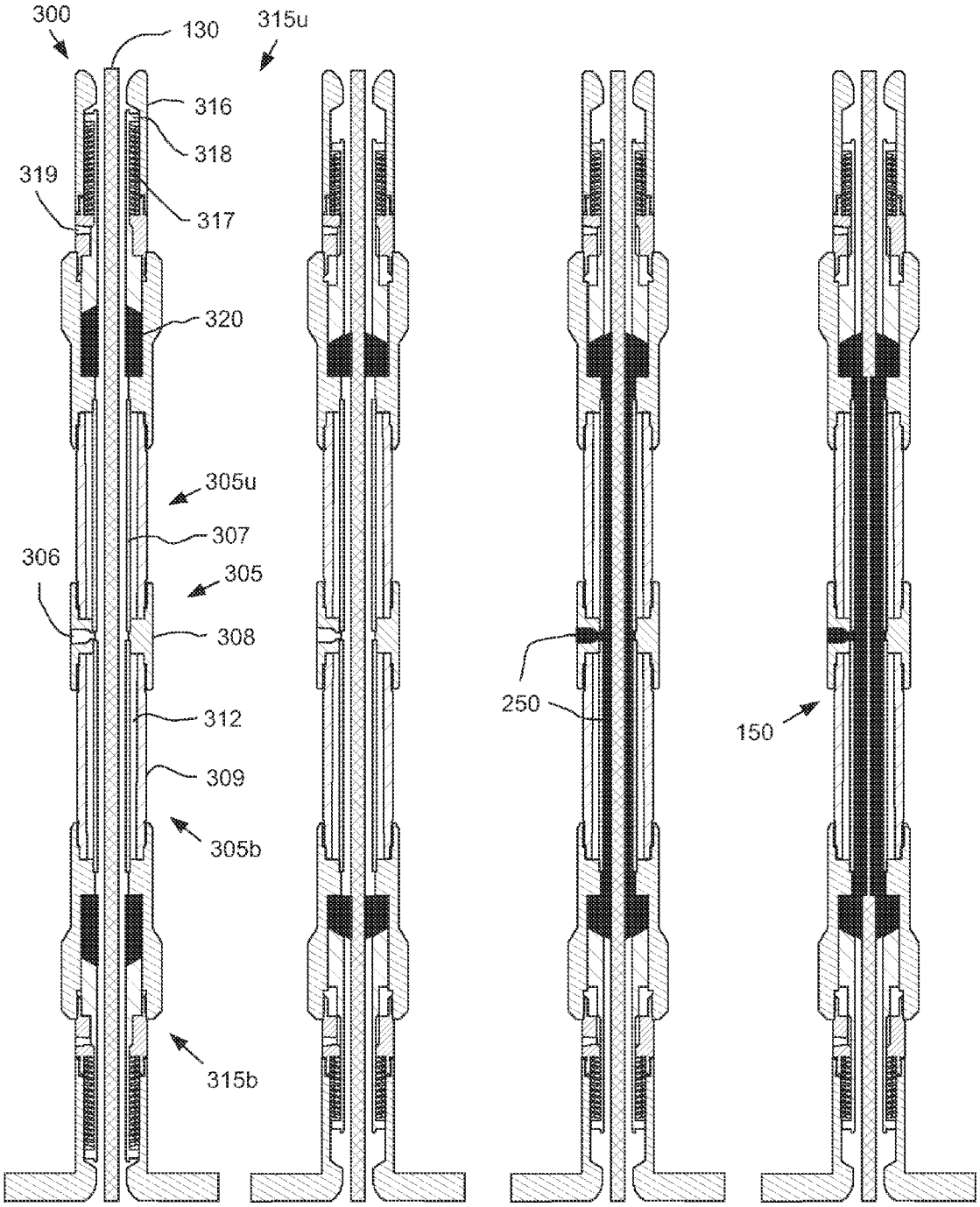
FIGS. 4A-4D illustrate molding a portion of the cable with sealant.

FIGS. 4A-4D illustrate molding a portion 150 of the cable 130 with the sealant 250. FIG. 4A is an enlargement of a portion of FIG. 3A illustrating the cable 130 extending through the mold 300. The mold 300 may include a runner 305, and upper 315*u* and lower 315*b* stuffing boxes. The runner 305 may include one or more tubular sections 305*u,b* connected by a coupling 308. Each section 305*u,b* may include a housing 309 and an insert 307. An annular coupling 308 may connect to each of the runner sections, such as by a threaded connection. Each housing 309 may also connect to a housing 316 of a respective stuffing box 315*u,b*, such as by a threaded connection. The coupling 308 may have a shoulder formed therein for receiving an end of each insert 307 and each stuffing box housing 316 may have a shoulder for receiving the other end of each insert. An inner diameter of the inserts 307 may be slightly greater than an outer diameter of the cable 130, thereby forming an annulus 312 between the inserts 307 and the cable 130. The coupling 308 may have a sprue 306 formed through a wall thereof in fluid communication with the annulus 312.

Each stuffing box 315*u,b* may include a tubular housing 316, a seal 320, a piston 318, and a spring 317. Each housing 316 may include one or more sections and each housing section may be connected, such as by threads. A port 319 may be formed through the housing in communication with the piston 318. The port 319 may be connected to the service truck HPU via a hydraulic conduit (not shown). When operated by hydraulic fluid, the piston 318 may longitudinally compress the seal 320, thereby radially expanding the seal 320 inward into engagement with the cable 130. The spring 317 may bias the piston 318 away from the seal 320. Alternatively, the spring 317 may be omitted and bias from the seal 320 may be used to disengage the seal from the cable 130.

FIG. 4B illustrates seals 320 of the mold 300 engaged with the cable 130. Once the cable 130 has been lowered to a depth proximately above the ESP deployment depth, hydraulic fluid may be supplied to the stuffing box ports 319, thereby engaging the stuffing box seals 320 with the cable 130.

FIG. 4C illustrates injection of sealant 250 into the mold 300. Once the seals 320 engage the cable 130, the mix head may be connected to the sprue 306. The sealant mixture 250 may then be pumped into the mold 300. Air displaced by the sealant mixture 250 may vent from the die via leakage through and along the armor 138*i,o*. The sealant mixture 250 may flow around and along the annulus 312 until the sealant mixture 250 encounters the seals 320. Pressure in the mold 300 may increase and the sealant mixture 250 may be forced into the armor 138*i,o*. Sealant penetration into the cable 130 may be stopped by the outer jacket 136. Pumping of the sealant mixture 250 may continue until the mold 300 is filled.

FIG. 4D illustrates a portion 150 of the cable 130 impregnated by the sealant 250. Once the sealant 250 has cured and cooled to at least a point sufficient to maintain structural integrity, hydraulic pressure may be relieved from the ports 319. The winch 124 may then be operated to pull the sealed portion 150 free from the mold 300 and may continue winding the cable 130 until an end of the cable is above the mold 300. The mix head may be disconnected from the mold 300. The mold 300 may be disconnected from the BOP 110. The service truck may stow the mold 300 and mix head and leave the wellsite.

FIG. 3B illustrates the ESP 105 and the stuffing box 115 being lowered toward the tree 50. The cable 130 may then be inserted through the stuffing box 115 and fastened to the cablehead 105. The boom 125 may be used to hoist the ESP 105 and stuffing box 115 over the BOP 110. The ESP 105 may be lowered through the tree 50 and into the wellbore 5 until the stuffing box 115 engages the BOP 110. Lowering may be halted and the stuffing box 115 may be fastened to the BOP 110. Lowering of the ESP 105 into the wellbore 5 may resume until the ESP is at the deployment depth.

FIG. 3C illustrates the ESP 105 deployed and operating. As the ESP 105 is lowered to the deployment depth, the sealed portion 150 may be lowered into alignment with the stuffing box seal. The isolation device 106 may then be set to engage the production tubing 10*p* and the stuffing box 115 may be operated to engaged the sealed portion 150. The ESP 105 may then be operated to pump production fluid 35 from the wellbore 5 to the tree 50 and through the tree to the surface separation, treatment, and storage equipment.

Advantageously, the sealed portion 150 obviates the need for grease injection while the ESP 105 is operating. Once the ESP 105 needs to be retrieved from the wellbore 5 for maintenance and/or replacement, the cable 130 may be inspected and reused to deploy the repaired/replaced ESP into the wellbore, the cable may be replaced and resealed, or the sealed portion may be cut and the remaining cable resealed to deploy the repaired/replaced ESP into the wellbore.

Alternatively, the cable 130 (with sealed portion 150) may be used to deploy and operate other downhole tools besides an ESP, such as a compressor.

While the foregoing is directed to embodiments of the present invention, other and further embodiments of the invention may be devised without departing from the basic scope thereof, and the scope thereof is determined by the claims that follow.

The invention claimed is:

1. A method of deploying a downhole tool into a wellbore, comprising:

lowering a cable into the wellbore;

after lowering the cable, engaging a mold with an outer surface of the cable;

injecting sealant into the mold and into armor of the cable, allowing the sealant to cure, and disengaging the mold from the cable, thereby sealing a portion of the cable;

lowering the downhole tool to a deployment depth using the cable;

engaging a seal with the sealed portion of the cable; and operating the downhole tool using the cable.

2. The method of claim 1, wherein:

the downhole tool is an electric submersible pump, and the electric submersible pump is operated to pump production fluid from the wellbore.

3. The method of claim 1, further comprising connecting the downhole tool to the cable.

4. The method of claim 3, wherein:

the downhole tool is connected before lowering the cable, and the cable is used to lower the downhole tool into the wellbore.

5. The method of claim 3, wherein:

the downhole tool is connected after injecting the sealant, and the cable is used to lower the downhole tool into the wellbore.

6. The method of claim 1, wherein:

the mold comprises a pair of semi-tubular housing segments and seals, and the mold seals are engaged with the cable by assembling the segments around the cable.

7. The method of claim 1, wherein:

the cable is inserted through the mold, and seals of the mold are engaged with the cable by operating respective actuators of the mold.

8. The method of claim 1, wherein the sealant is a polymer.

9. The method of claim 8, wherein:

the sealant is a mixture of a resin and a hardener, and the resin and hardener are mixed as the sealant is injected into the mold.

10. The method of claim 8, wherein the sealant is molten when injected into the mold.

11. The method of claim 1, further comprising connecting a stuffing box to a wellhead, wherein the stuffing box comprises the seal.

12. The method of claim 1, wherein:

a length of the cable is greater than or equal to five hundred feet, and a length of the sealed portion is less than or equal to one-tenth of the cable length.

* * * * *